US011389925B2

(12) United States Patent
Zuniga et al.

(10) Patent No.: US 11,389,925 B2
(45) Date of Patent: Jul. 19, 2022

(54) OFFSET HEAD-SPINDLE FOR CHEMICAL MECHANICAL POLISHING

(71) Applicant: Applied Materials, Inc., Santa Clara, CA (US)

(72) Inventors: Steven M. Zuniga, Soquel, CA (US); Jay Gurusamy, Santa Clara, CA (US); Bum Jick Kim, Irvine, CA (US); Danielle Loi, San Jose, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 240 days.

(21) Appl. No.: 16/690,062

(22) Filed: Nov. 20, 2019

(65) Prior Publication Data

US 2020/0156206 A1 May 21, 2020

Related U.S. Application Data

(60) Provisional application No. 62/770,716, filed on Nov. 21, 2018.

(51) Int. Cl.

| | |
|---|---|
| ***B24B 37/30*** | (2012.01) |
| ***B24B 37/10*** | (2012.01) |
| ***B24B 37/07*** | (2012.01) |

(52) U.S. Cl.

CPC ..... *B24B 37/30* (2013.01); *B24B 37/07* (2013.01); *B24B 37/10* (2013.01); *B24B 37/102* (2013.01); *B24B 37/105* (2013.01)

(58) Field of Classification Search

CPC .. B24B 7/228; B24B 7/07; B24B 7/10; B24B 7/102; B24B 7/105; B24B 7/30; B24B 45/003; B24B 41/047; B24B 37/04; B24B 37/005; B24B 37/042; B24B 37/107

USPC ..... 451/41, 285, 287, 290, 291

See application file for complete search history.

(56) References Cited

U.S. PATENT DOCUMENTS 5,624,299 A * 4/1997 Shendon ..... B24B 37/105 451/286
5,738,574 A 4/1998 Tolles et al.
5,951,373 A * 9/1999 Shendon ..... B24B 37/32 451/287
5,997,384 A * 12/1999 Blalock ..... B24B 21/004 451/285

(Continued)

FOREIGN PATENT DOCUMENTS

DE 202007010059 U1 * 10/2007 ..... B24B 7/28
EP 0865874 A2 * 9/1998 ..... B24B 57/02

(Continued)

OTHER PUBLICATIONS

International Search Report and Written Opinion of the International Search Authority for PCT/US2019/062505 dated Mar. 5, 2020, 13 pages.

*Primary Examiner* — Joel D Crandall
*Assistant Examiner* — Jason Khalil Hawkins
(74) *Attorney, Agent, or Firm* — Patterson + Sheridan LLP

(57) ABSTRACT

A polishing system is provided, including a carrier with an offset distance. The offset distance allows a shifted carrier head to cover more surface area of the polishing surface. The offset distance effectively provides an additional rotation of the carrier head about the axis, which allows for a greater area traversed on the polishing surface, improving chemical mechanical polishing uniformity on the substrate.

21 Claims, 10 Drawing Sheets

(56) References Cited

U.S. PATENT DOCUMENTS 6,152,805 A * 11/2000 Takahashi ..... B24B 31/116 451/104
6,184,139 B1 * 2/2001 Adams ..... B24B 23/03 438/692
6,561,881 B2 * 5/2003 Jeong ..... B24B 37/30 451/285
6,712,674 B2 * 3/2004 Matsuo ..... B24B 37/042 451/270
6,857,950 B2 * 2/2005 Hayashi ..... B24B 41/068 438/692
7,186,165 B2 * 3/2007 Jeong ..... B24B 37/013 451/11
7,226,337 B2 6/2007 David
7,273,408 B2 * 9/2007 Chen ..... B24B 37/345 451/11
7,967,661 B2 * 6/2011 Taylor ..... B24B 37/205 451/6
8,172,643 B2 * 5/2012 Yilmaz ..... B24B 37/04 451/11
8,357,029 B2 * 1/2013 Fukushima ..... B24B 37/30 451/286
9,056,383 B2 6/2015 David et al.
10,076,817 B2 * 9/2018 Chen ..... B24B 37/10
10,105,812 B2 * 10/2018 Chen ..... B24B 37/26
10,589,399 B2 * 3/2020 Oh ..... B24B 37/26
10,892,165 B2 * 1/2021 Toshikawa ..... B24B 49/16
11,072,049 B2 * 7/2021 Chen ..... B24B 37/11
2001/0019934 A1 * 9/2001 Nishimura ..... B24B 37/04 451/8
2001/0027080 A1 10/2001 Wiswesser et al.
2002/0037685 A1 * 3/2002 Matsuo ..... B24B 37/042 451/41
2002/0119731 A1 8/2002 Hofmann
2005/0000943 A1 * 1/2005 Sugaya ..... B24B 37/30 156/345.12
2014/0024299 A1 * 1/2014 Tu ..... B24B 37/26 451/282
2016/0016282 A1 * 1/2016 Chen ..... B24B 37/30 451/526
2016/0101497 A1 4/2016 David et al.
2017/0203408 A1 7/2017 Ganapathiappan et al.
2020/0101577 A1 * 4/2020 Kim ..... B24B 37/30

FOREIGN PATENT DOCUMENTS

KR 20140146948 A 12/2014
WO 2016010866 A1 1/2016

* cited by examiner

OFFSET HEAD-SPINDLE FOR CHEMICAL MECHANICAL POLISHING

CROSS-REFERENCE TO RELATED APPLICATIONS

This application claims the benefit of U.S. Provisional Patent Application No. 62/770,716, filed Nov. 21, 2018, which is hereby incorporated by reference in its entirety.

BACKGROUND

Field

The present invention relates generally to a method and an apparatus used to polish a substrate. More specifically, this invention relates to a chemical mechanical polishing system.

Description of the Related Art

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the nonplanar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing surface of a polishing pad. The carrier head provides a controllable load on the substrate to push it against the polishing surface. An abrasive polishing slurry is typically supplied to the surface of the polishing surface as the substrate is urged against the polishing surface.

Variations in the slurry distribution, the polishing surface condition of the polishing pad, the relative speed between the polishing surface and the substrate, and the load on the substrate can cause variations in the material removal rate across the substrate. One drawback of CMP systems in the current art is a small variation in the head sweep, which causes the polishing surface to go over the same area multiple times and results in the non-uniform polishing of the wafers.

Therefore, there is a need in the art for a way to provide a uniform polishing of a substrate.

SUMMARY OF INVENTION

Embodiments of the disclosure may provide a polishing system, including two polishing stations. The polishing stations include a platen for holding a polishing surface. The polishing system also includes a support structure that is moveable between the two polishing stations. The polishing system includes a motor, attached to the support structure, which is located an offset distance horizontally from the carrier head, and connected to the carrier head by a coupling. The polishing system may also include a controller that moves the carrier head from station to station.

In one embodiment, a polishing system is provided, including a first polishing station, including a platen that has a polishing surface and a platen central axis about which the platen is configured to rotate, and a carrier head assembly. The carrier head assembly includes a carriage that is configured to be positioned relative to a portion of a support structure of the polishing system by a carrier motor, a carrier head that is configured to retain a substrate, an offset coupler; and a carrier head motor having a drive shaft. The carrier head motor is coupled to the carriage. The drive shaft and the carrier head are coupled together by the offset coupler. A rotational axis of the drive shaft is located an offset distance parallel to the polishing surface from a head central axis of the carrier head. The head central axis is not, or is only intermittently, collinear with the platen central axis during the polishing process.

In another embodiment, a carrier head assembly is provided, including a carrier head that is configured to retain a substrate and urge the substrate against a polishing surface of a platen, an offset coupler, and a carrier head motor having a drive shaft. The carrier head motor is coupled to a supporting structure. The drive shaft and the carrier head are coupled together by the offset coupler. A rotational axis of the drive shaft is located an offset distance parallel to the polishing surface from a central axis of the carrier head.

In another embodiment, a method of polishing a substrate is provided, including urging the substrate against a polishing surface of a platen by a carrier head assembly, rotating the carrier head about a rotational axis of a drive shaft, and rotating the platen about a platen central axis. The carrier head assembly includes a carrier head that is configured to retain the substrate, an offset coupler and a carrier head motor having a drive shaft. The carrier head motor is coupled to a supporting structure. The drive shaft and the carrier head are coupled together by the offset couple. The rotational axis of the drive shaft is located an offset distance parallel to the polishing surface from a central axis of the carrier head. The rotating the carrier head is caused by the carrier head motor. The central axis is not, or is only intermittently, collinear with a platen central axis during the polishing process.

The offset distance allows a shifted carrier head to cover more surface area of the polishing surface. The offset distance effectively provides an additional rotation of the carrier head about the axis, which allows for a greater area traversed on the polishing surface, resulting in greater substrate surface uniformity.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

DETAILED DESCRIPTION

Embodiments of the disclosure provided herein include a polishing method and apparatus used to provide a uniform polishing of a surface of a substrate. In some embodiments, a carrier head is shifted relative to the attachment point of the support structure. The rotation of the carrier head around the offset attachment point results in more of the polishing surface being accessed due to a larger surface area of the pad being accessed, and reduces the amount of frictional force provided to a carrier head motor attached to a carriage that supports carrier head during operation. Embodiments of the disclosure provided herein may be especially useful for, but are not limited to, improving the polishing performance of a chemical mechanical polishing system.

Figure 1A:
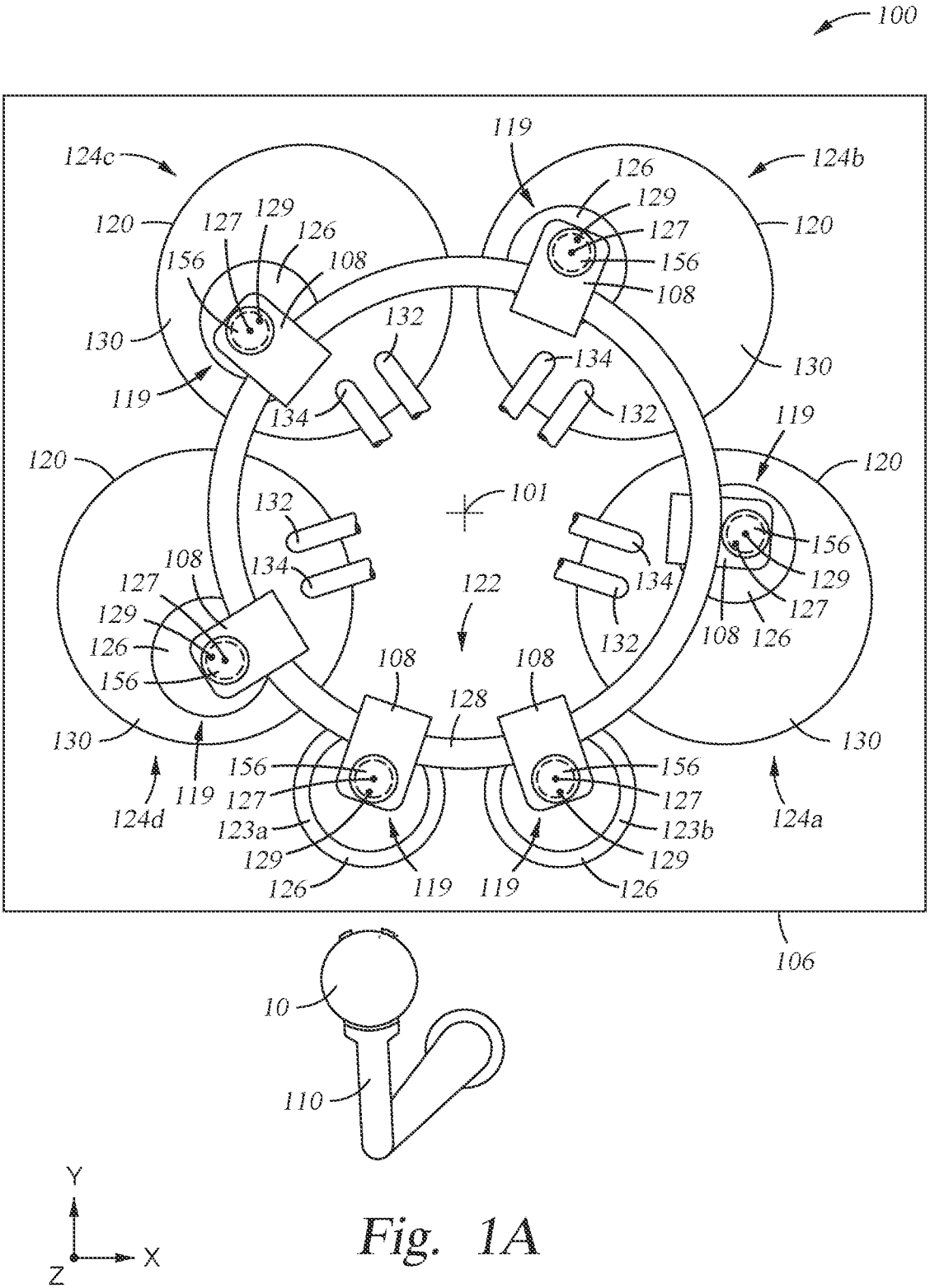
FIG. 1A is a top view of a CMP system with multiple polishing stations and a curved track for the movement of a carrier head, according to one embodiment.
Figure 2A:
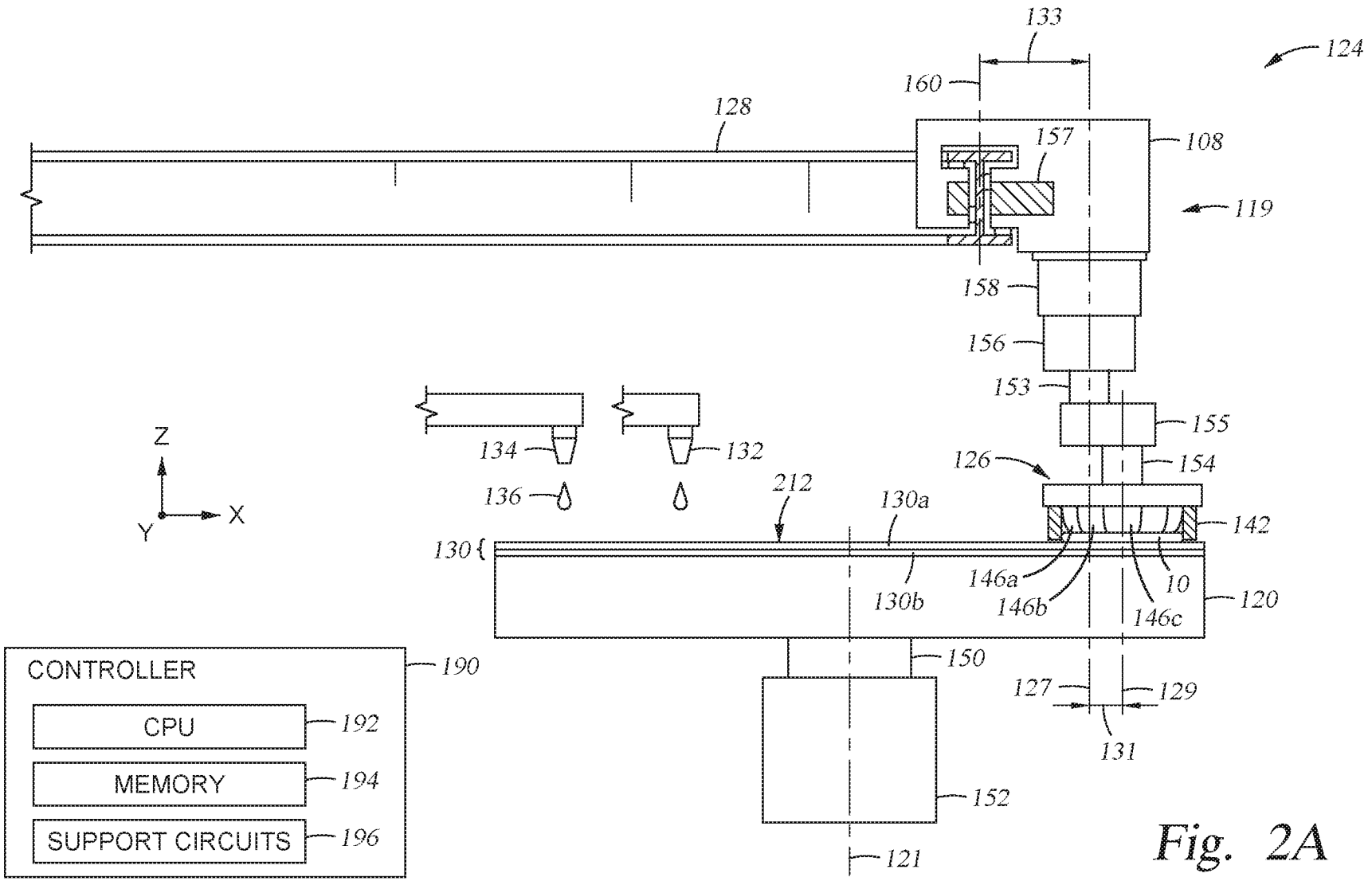
FIG. 2A is a side cross sectional view of a polishing station, according to one embodiment.

FIG. 1A is a plan view of a polishing system 100, which contains an overhead track 128, and several carrier head assemblies 119, which carry the substrates 10 around the system during processing. The geometry of the polishing system 100 is often limited due to various physical constraints, such as the size constraint of the polishing system and the interaction of the polishing stations 124 with various other processing chambers and components within the polishing system. Therefore, it is often not possible to substantially change the locations of the polishing stations 124 or the radius of overhead track 128 which is used to guide and transfer the carrier heads 126 within the carrier head assemblies 119 to the various polishing stations. A modification to a polishing system is shown in FIG. 2A. Here, the carrier head 126 is offset from axis 127 about which the carrier head motor 156 rotates. As shown in FIG. 3B, this allows the carrier head 126 to reach more of the surface area of the polishing surface 130 of the polishing pad, without changing the geometry of the components within the polishing system 100, such as the platen 120 and overhead track 128. As shown in FIG. 2A, the polishing surface 130 is positioned on a top surface of the platen 120.

Figure 4A:
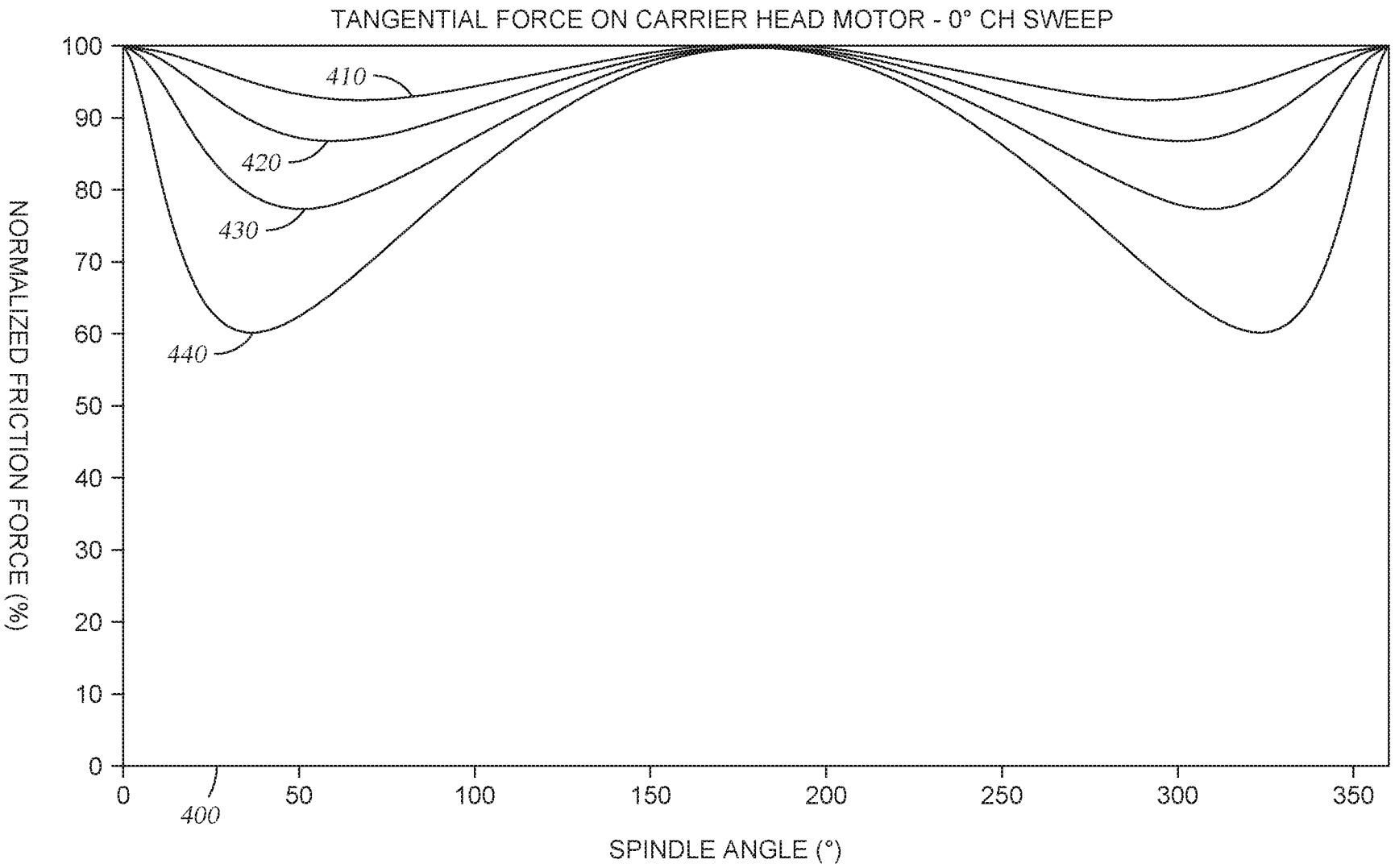
FIG. 4A is a plot of the normalized friction force respect to the spindle angle at a zero degree sweep angle.

FIG. 4A shows a plot of the normalized friction force at different rotational angles of the carrier head 126 with respect to the axis 127, where 100% on the Y-axis signifies the frictional force experienced by a traditional carrier head with no offset during a polishing process. The frictional force on the carrier head 126 will cause a corresponding opposite but equal force to be applied to the carrier motor 157. The vector component of the frictional forces that is in the direction of travel of the carrier head assemblies 119 along the overhead track 128 requires the carrier motor 157 to apply an equal and opposite force to maintain its position along the overhead track 128, and thus otherwise prevent the carrier head assemblies 119 from sliding along the track 128. The forces applied to the carrier motor 157 during processing puts extra wear and tear on the carrier motor 157, and thus shortens its useable life and often cause the carrier motor 157 to be oversized to compensate for the applied loads. However, FIG. 4A shows that the normalized frictional force for one or more of the embodiments of the carrier head 126 described herein, such as the use of an offset carrier head 126, is reduced with respect to the normalized frictional force for a conventional carrier head which has no offset. Thus, the normalized frictional force is always, at the worst case, the same as a carrier head 126 with no offset, while for the majority of the angles, the normalized frictional force is less. Thus, the embodiments of the offset carrier head 126 described herein always results in an equal or reduced normalized force provided to the carrier motor 157. Therefore, the offset carrier head 126 improves the polishing of the substrate 10 without modifications being made to the rest of the polishing system 100 and size of the carrier motor 157.

FIG. 1A illustrates a plan view of a polishing system 100 for processing one or more substrates, according to one embodiment. The polishing system 100 includes a polishing platform 106 that at least partially supports and houses a plurality of polishing stations 124*a*-124*d* and load cups 123*a*-123*b*. However, in some embodiments, the number of polishing stations can be equal to or greater than one. For example, the polishing apparatus can include four polishing stations 124*a*, 124*b*, 124*c* and 124*d*. Each polishing station 124 is adapted to polish a substrate that is retained in a carrier head 126 within a carrier head assembly 119 that translates along an overhead track 128. The carrier head assembly 119 is moved along the track 128 by a carrier motor 157 attached to the carriage 108. The carriage 108 generally includes structural elements that that are able to guide and facilitate the control of the position of the carrier head assembly 119 along the overhead track 128. In some embodiments, carrier motor 157 and carriage 108 include a linear motor and linear guide assembly that are configured to position the carrier head assembly 119 along all points of the circular overhead track 128.

The polishing system 100 also includes a multiplicity of carrier heads 126, each of which is configured to carry a substrate 10. The number of carrier heads can be an even number equal to or greater than the number of polishing stations, e.g., four carrier heads or six carrier heads. For example, the number of carrier heads 126 can be two greater than the number of polishing stations. This permits loading and unloading of substrates to be performed from two of the carrier heads while polishing occurs with the other carrier heads at the remainder of the polishing stations, thereby providing improved throughput.

The polishing system 100 also includes a loading station 122 for loading and unloading substrates from the carrier heads. The loading station 122 can include a plurality of load cups 123, e.g., two load cups 123*a*, 123*b*, adapted to facilitate transfer of a substrate between the carrier heads 126 and a factory interface (not shown) or other device (not shown) by a transfer robot 110. The load cups 123 generally facilitate transfer between the robot 110 and each of the carrier heads 126.

A controller 190, such as a programmable computer, is connected to each motor 152, 156 to independently control the rotation rate of the platen 120 and the carrier heads 126. For example, each motor can include an encoder that measures the angular position or rotation rate of the associated drive shaft. Similarly, the controller 190 is connected to a carrier motor 157 (FIGS. 1A and 2A) in each carriage 108 to independently control the lateral motion and position of each carrier head 126 along the track 128. For example, each carrier motor 157 can include a linear encoder that monitors and controls the position of the carriage 108 along the track 128.

The controller 190 can include a central processing unit (CPU) 192, a memory 194, and support circuits 196, e.g., input/output circuitry, power supplies, clock circuits, cache, and the like. The memory 194 is connected to the CPU 192. The memory is a non-transitory computable readable medium, and can be one or more readily available memory such as random access memory (RAM), read only memory (ROM), floppy disk, hard disk, or other form of digital storage. In addition, although illustrated as a single computer, the controller 190 could be a distributed system, e.g., including multiple independently operating processors and memories. This architecture is adaptable to various polishing situations based on programming of the controller 190 to control the order and timing that the carrier heads are positioned at the polishing stations.

For example, some polishing recipes are complex and require three of four polishing steps. Thus, a mode of operation is for the controller 190 to cause a substrate to be loaded into a carrier head 126 at one of the load cups 123, and for the carrier head 126 to be positioned in turn at each polishing station 124*a*, 124*b*, 124*c*. 124*d* so that the substrate is polished at each polishing station in sequence. After polishing at the last station, the carrier head 126 is returned to one of the load cups 123 and the substrate is unloaded from the carrier head 126.

The stations of the polishing system 100, which include the loading station 122 and the polishing stations 124, can be positioned at substantially equal angular intervals around the center of the polishing platform 106. This is not required, but can provide the polishing system 100 with a good lateral footprint. Each polishing station 124 of the polishing system 100 can include a port, e.g., at the end of a carousel arm 138, to dispense polishing liquid 136 (see FIG. 2A), such as abrasive slurry, onto the polishing surface 130. Each polishing station 124 of the polishing system 100 can also include pad conditioning apparatus 132 to abrade the polishing surface 130 to maintain the polishing surface 130 in a consistent abrasive state. The platen 120 at each polishing station 124 is operable to rotate about a platen central axis 121. For example, a motor 152 can turn a drive shaft 150 to rotate the platen 120. Each carrier head 126 is operable to hold a substrate 10 against the polishing surface 130. In operation, the platen 120 is rotated about the platen central axis 121, which provides polishing to the substrate 10. Each carrier head 126 can have independent control of some of the polishing parameters, for example pressure, associated with each respective substrate. In particular, each carrier head 126 can include a retaining ring 142 to retain the substrate 10 below a flexible membrane 144.

Each carrier head assembly 119 is suspended from the track 128. A connection axis 160 extends through the carrier motor 157 to the polishing surface 130. The connection axis 160 is separated from the axis 127 of the drive shaft 153 by an extended distance 133. Each carrier head assembly includes a carrier head 126 that is connected by a carrier head drive shaft 154, through an offset coupler 155, to a carrier head motor 156. The carrier head 126 is coupled to the carriage 108 via a supporting structure 158, which may include brackets and other mounting components. The axis 127, which extends through the drive shaft 153 of the carrier head motor 156 and the carrier head axis 129 are separated by an offset distance 131 (alternately referred to as an offset). As shown in FIG. 3B, the offset distance 131 allows the carrier head 126 to reach more of the surface area of the polishing surface 130, without changing the geometry of the polishing station or of the platen 120 and polishing surface 130. In one embodiment, the offset coupler 155 length is fixed, and thus the offset distance 131 is fixed. In one example, the offset distance 131 is set to a fixed distance of between about 1 mm and about 150 mm, such as between about 2 mm and about 50 mm. In one example, the offset distance 131 is between about 0.01% and about 25% of the diameter of a track 128 that is curved. In another example, the offset distance 131 is between about 0.1% and about 10% of the diameter of a track 128 that is curved. In one embodiment, the extended distance 133 and the offset distance 131 are the same, which allows the carrier head 126 to rotate directly under and be positioned directly under the circular track 128. Defining the extended distance 133 so that it is substantial equal to the offset distance 131 will allow the carrier head to be statically positioned so that no apparent offset exists, which facilitates the loading and unloading from inboard load cups 123*a*, 123*b*, and thus help to reduce the overall size of the polishing system 100.

In one embodiment, each carrier head 126 can oscillate laterally (X-Y plane in FIG. 1A) during polishing, e.g., by driving the carriage 108 on the track 128. The carrier head 126 is generally translated laterally across the top surface of the polishing surface 130 during polishing. The lateral sweep is in a direction parallel to the polishing surface 212 (FIG. 2A). The lateral sweep can be a linear or arcuate motion. Each of the above embodiments that allow for additional modes of oscillation or motion allows for even more relative motion between the polishing surface 130 and the substrate 10, increasing the polishing rate on the substrate.

Figure 2B:
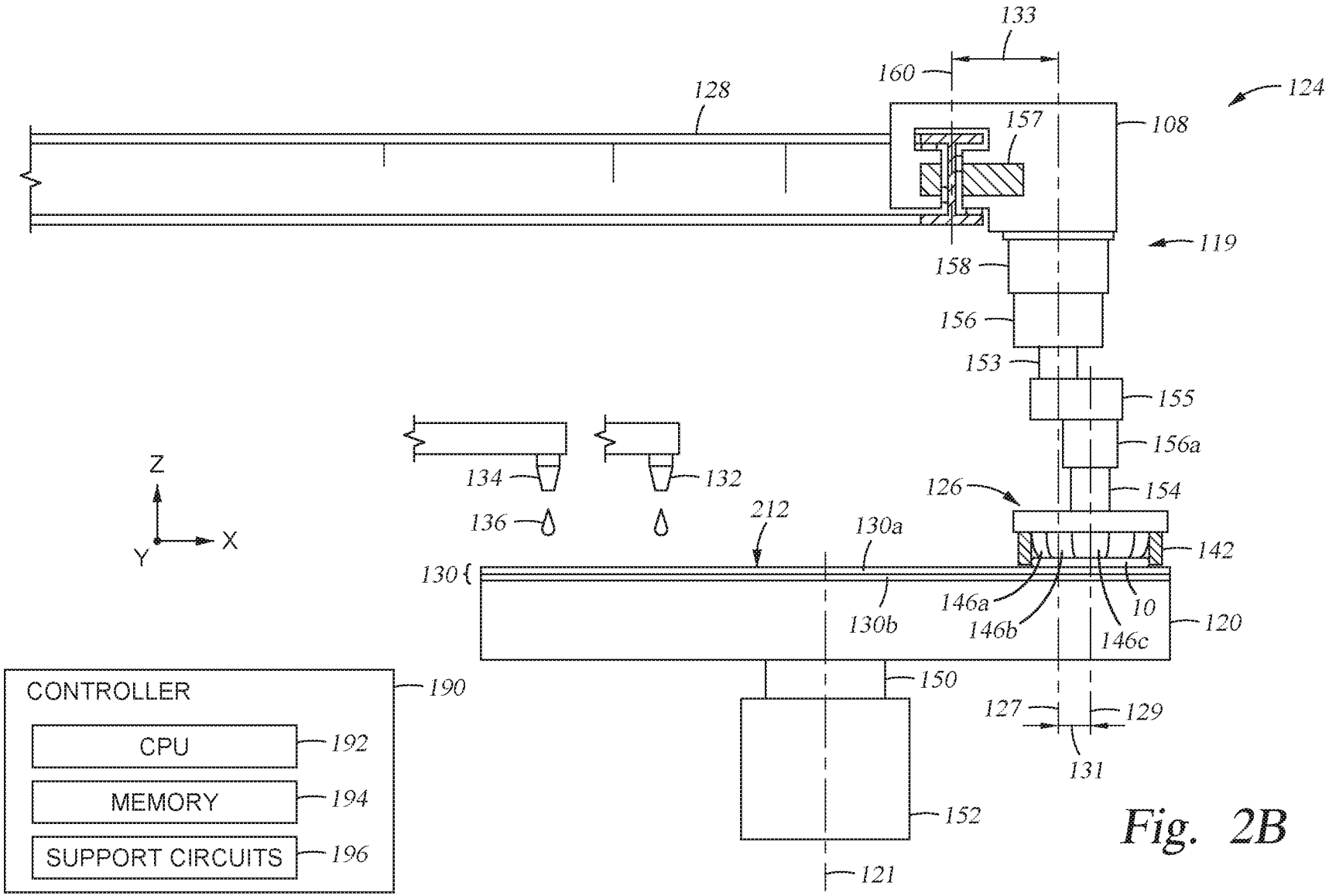
FIG. 2B is a side cross sectional view of a polishing station with an independent motor, according to one embodiment.

FIG. 2B illustrates a side view of a polishing station 124 for processing one or more substrates, according to one embodiment. Although the polishing station 124 is similar to that as shown in FIG. 2A, in this embodiment, a secondary motor 156*a* is included, which is attached between the offset coupler 155 and the carrier head 126. The secondary motor 156*a* allows for an additional rotational motion about the carrier head axis 129 of the carrier head 126. The additional rotation of the carrier head 126 about the carrier head axis 129 allows for even more relative motion between the polishing surface 130 and the substrate 10, increasing the polishing rate on the substrate. In another embodiment, the platen 120 rotation and the carrier head 126 rotation is mismatched, which prevents repeatedly polishing a point in the substrate with the same portion of the pad at subsequent rotations of the platen. With a small mismatch, the point in the substrate will be polished at subsequent rotations by neighboring portions of the polishing surface 130.

In some embodiments, each carrier head 126 also includes a plurality of independently controllable pressurizable chambers 146 defined by the membrane, e.g., three chambers 146*a*-146*c*, which can apply independently controllable pressurizes to associated zones on the flexible membrane 144 and thus on the substrate 10. Although only three chambers are illustrated in FIG. 2A for ease of illustration, there could be one or two chambers, or four or more chambers, e.g., five chambers.

Each polishing station 124 includes a polishing surface 130 supported on a platen 120, according to one embodiment. The polishing surface 130 can be a two-layer polishing pad with an outer polishing layer 130*a* and a softer backing layer 130*b*, according to one embodiment. In some embodiments, the polishing surface 130 comprises a sheet of polishing material. In one embodiment, the sheet is delivered by rollers attached to the sides of the polishing station 124, and drawn taut.

In one embodiment, for a polishing operation, one carrier head 126 is positioned at each polishing station. Two additional carrier heads can be positioned in the loading station 122 to exchange polished substrates for unpolished substrates while the other substrates are being polished at the polishing stations 124.

The carrier heads 126 are held by a support structure that can cause each carrier head to move along a path that passes, in order, the first polishing station 124*a*, the second polishing station 124*b*, the third polishing station 124*c*, and the fourth polishing station 126*d*. This permits each carrier head to be selectively positioned over the polishing stations 124 and the load cups 123. In some embodiments, the support structure comprises a carriage 108 that is mounted to an overhead track 128. By moving a carriage 108 along the overhead track 128, the carrier head 126 can be positioned over a selected polishing station 124 or load cup 123. A carrier head 126 that moves along the track 128 will traverse the path past each of the polishing stations.

In the embodiment depicted in FIG. 1A, the overhead track 128 has a circular configuration which allows the carriages 108 retaining the carrier heads 126 to be selectively orbited over and/or clear of the loading stations 122 and the polishing stations 124. The overhead track 128 may have other configurations including elliptical, oval, linear or other suitable orientation.

Figure 1B:
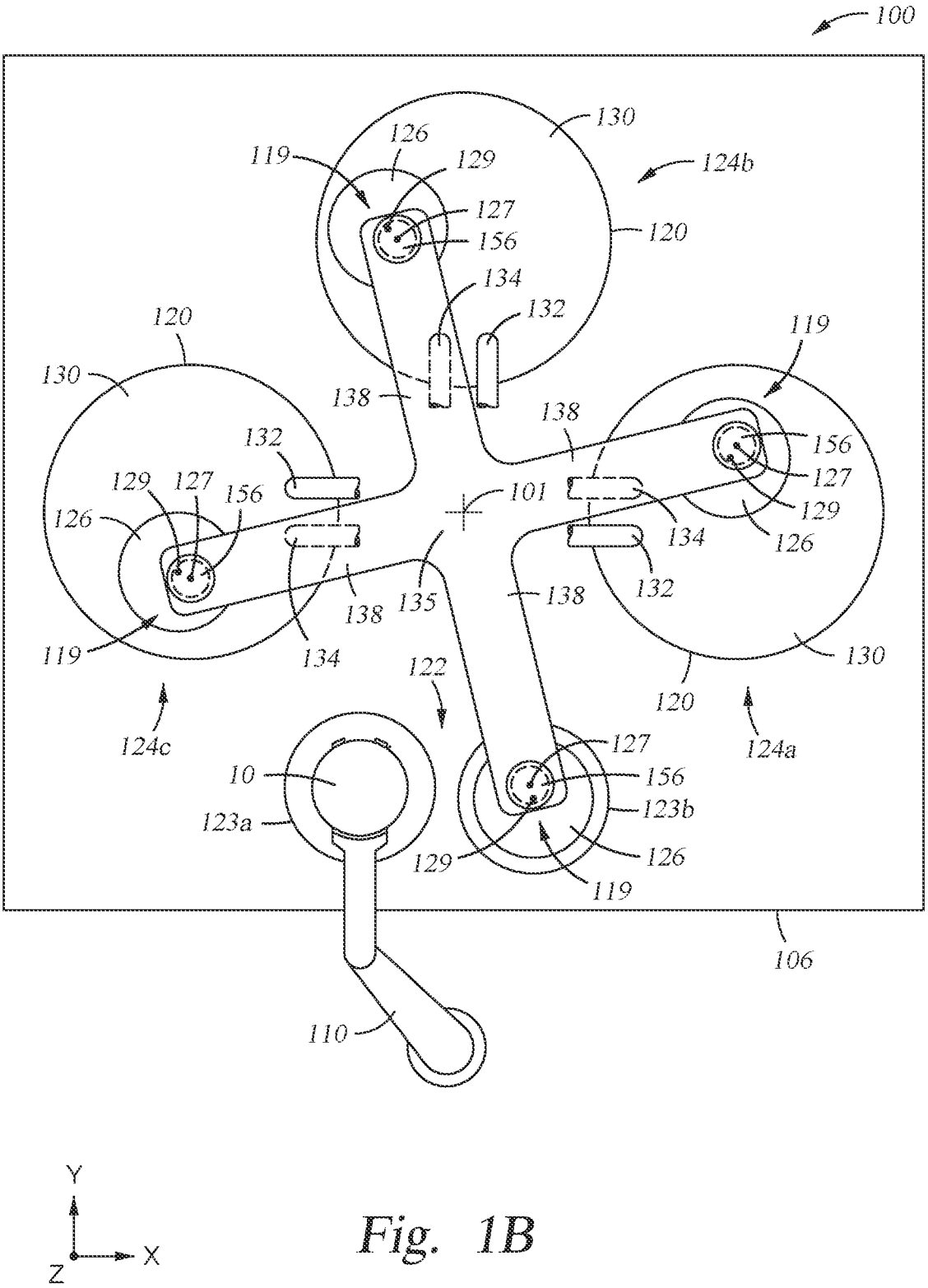
FIG. 1B is a top view of a CMP system with multiple polishing stations and a cross carousel for the movement of carrier heads, according to one embodiment.

Alternatively, in some implementations the support structure comprises a carousel 135 with a plurality of carousel arms 138 and the supporting structure 158 attaches directly to a carousel arm 138, so that rotation of the carousel moves all of the carrier heads simultaneously along a circular path (FIG. 1B). The carousel 135 allows uniform transfer of all the carrier heads 126 and associated substrates 10 simultaneously. In one embodiment, the carousel 135 can rotationally oscillate during polishing. The carrier head 126 is generally translated laterally across the top surface of the polishing surface 130 during polishing. The lateral sweep is in a direction parallel to the polishing surface 212 (FIG. 2A). The lateral sweep can be a linear or arcuate motion. Each of the above embodiments that allow for additional modes of oscillation or motion allows for even more relative motion between the polishing surface 130 and the substrate 10, increasing the polishing rate on the substrate.

Figure 3A:
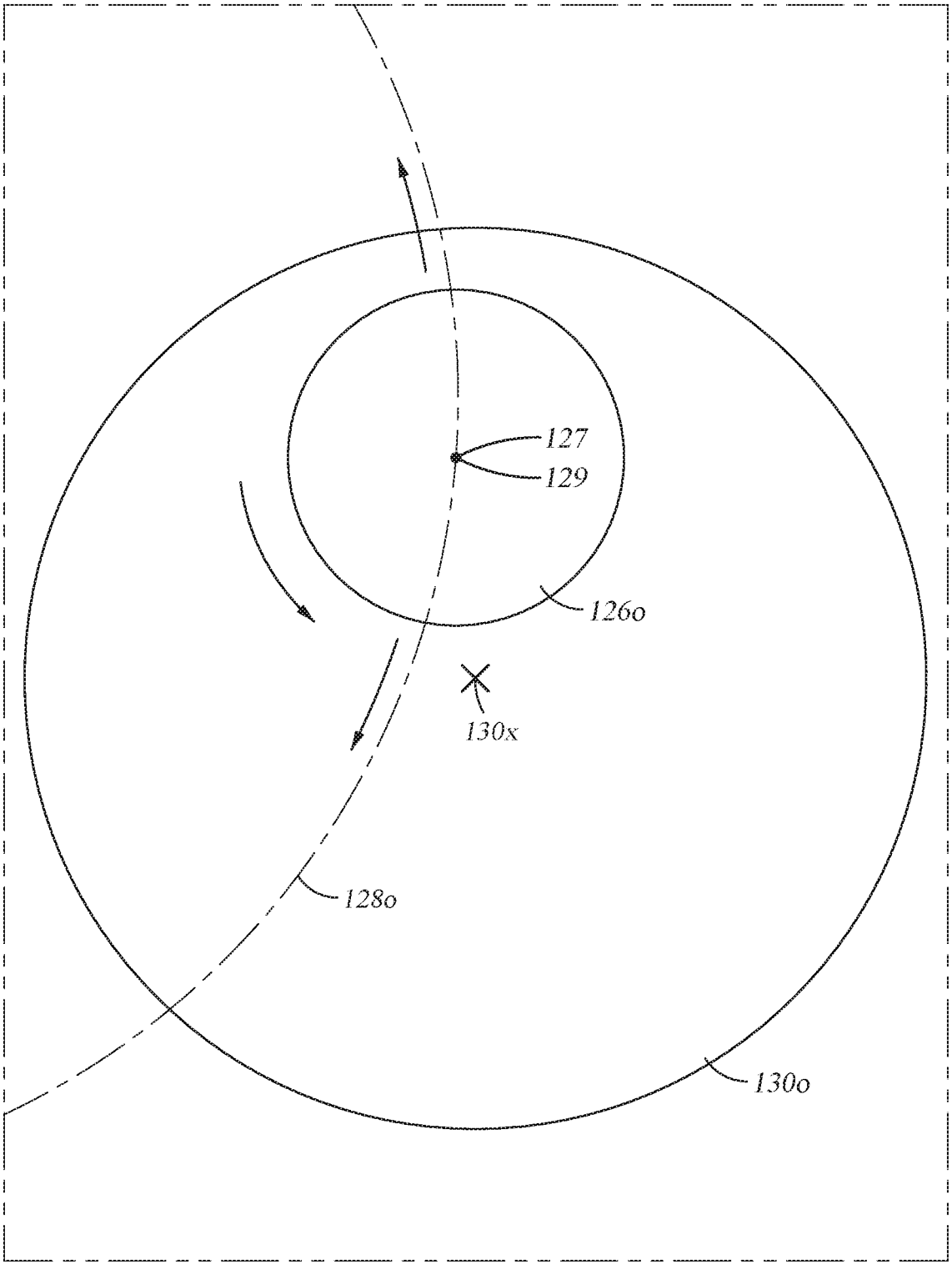
FIG. 3A is a diagram of the path of the outline of the substrate during a polishing cycle without a head-sweep offset.
Figure 3B:
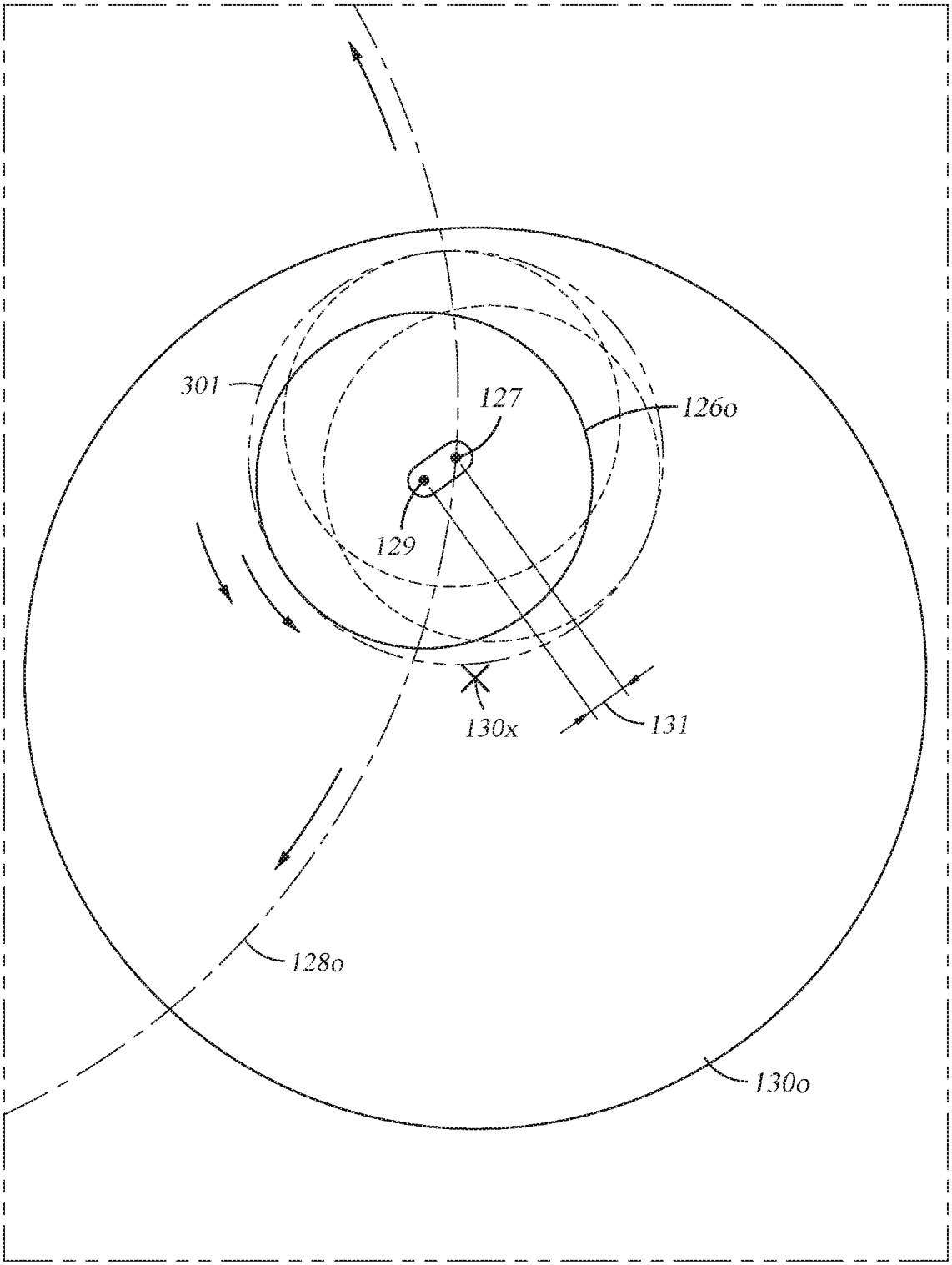
FIG. 3B is a diagram of the path of the outline of the substrate during a polishing cycle with a head-sweep offset, according to one embodiment.

FIG. 3A illustrates an overhead view of the polishing surface 130, which comprises carrier head outline 126*o*. The carrier head outline 126*o* shows the spatial extent of the carrier head 126 while being rotated by the carrier head motor 156 about axis 127. The polishing surface outline 130*o* shows the spatial extent of the entire polishing surface 130, with an 'x' indicating the center of the polishing surface 130*x* and rotational axis 121 (FIG. 2A) of the platen 120. The overheard track outline 128*o* shows the path the carrier head 126 moves across the polishing surface 130, with arrows indicating the motion of the carrier head along the overhead track 128. In this embodiment, the offset distance 131 is zero, and the axis 127 and carrier head axis 129 lie on top of one another, and thus illustrates a conventional configuration that has no offset distance 131.

In comparison, FIG. 3B shows a diagram of the carrier head outline 126*o* while being rotated by the carrier head motor 156 about axis 127 and the carrier head axis 129 is separated from the axis by an offset distance 131. The polishing surface outline 130*o* shows the extent of the entire polishing surface 130, with an 'x' indicating the center of the polishing surface 130*x* and rotational axis 121 (FIG. 2A) of the platen 120. The overheard track outline 128*o* shows the path the carrier head 126 moves across the polishing surface 130, with arrows indicating the motion of the carrier head along the overhead track 128. In this embodiment, the offset distance 131 is nonzero; in other words, the axis 127 and the carrier head axis 129 no longer lie on top of one another. As the offset coupler 155*o* rotates around the axis 127, the carrier head outline 126*o* also moves around the surface of the polishing surface 130. Thus, with a nonzero offset distance 131, the substrate 10 experiences a wider area of polishing (e.g., item 301), allowing it to be polished by more varied portions of the polishing surface 130. Since polishing on the same portion of the polishing surface 130 degrades the surface of the polishing surface, repeated polishing on the same worn down portion leads to uneven polishing. Thus, allowing the substrate to be polished by larger and more varied portions of the polishing surface 130 leads to less surface degradation of the polishing surface, and thus a more uniform polish. In addition, a larger portion of the polishing surface 130 is activated, and this lower costs to the consumer, who gets more use out of each polishing surface 130.

Figure 3C:
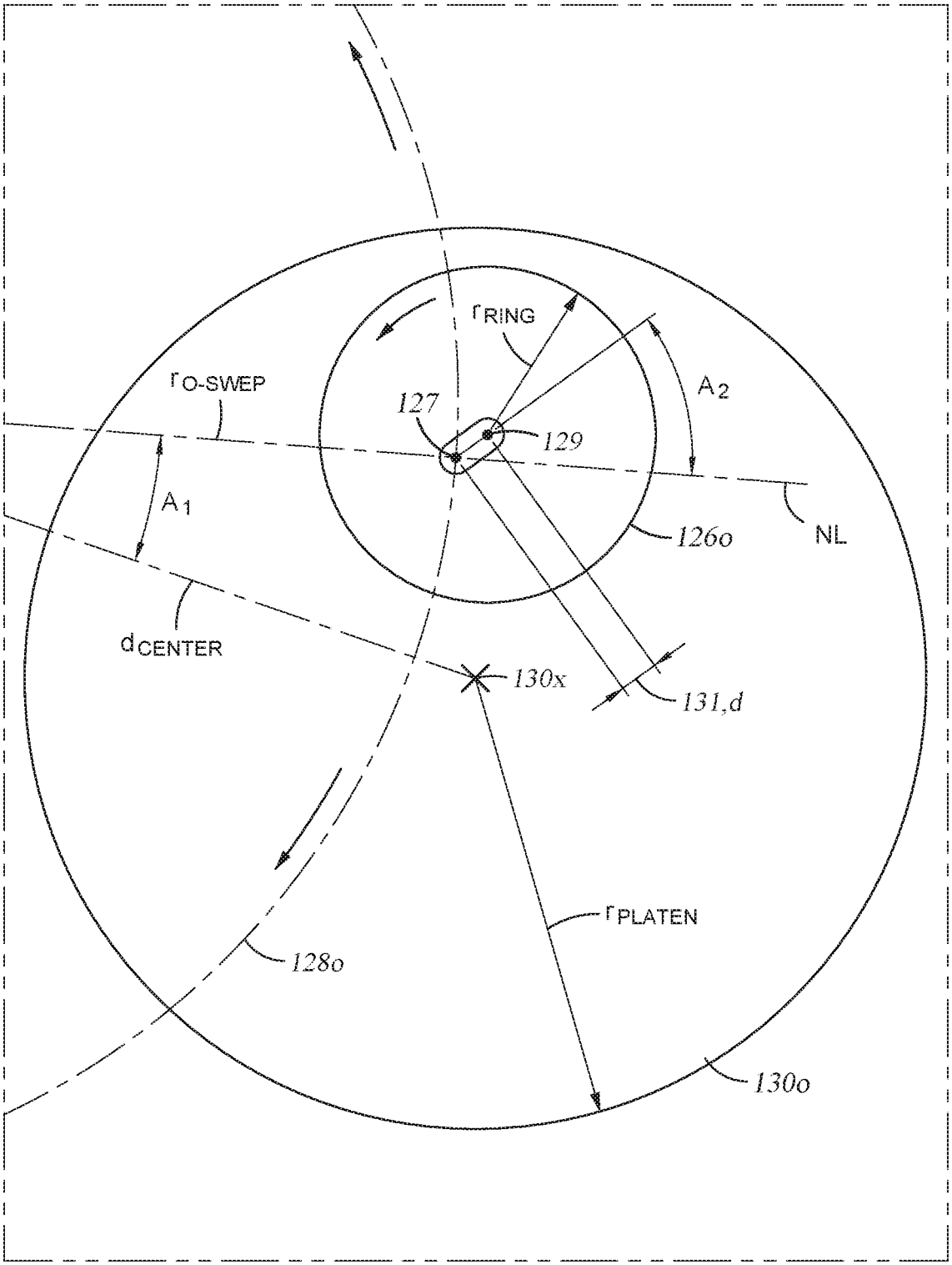
FIG. 3C is a diagram of the outline of the substrate at an instant of time during a polishing cycle in which a head-sweep offset is used, according to one embodiment.

FIG. 3C illustrates a diagram of the carrier head, when the carriage 108 is stationary on the track outline 1280. A carrier head (CH) sweep angle $A_1$ is formed between a line from the center 101 (FIG. 1A) of the circular track 128 to the center of the polishing surface 130*x*, and a line from the center of the circular track to the axis 127. An offset angle $A_2$ is formed between a line that is normal to the tangent of the circular track 128*o* at the location of the axis 127, and a line that extends from the axis 127 and the carrier head axis 129. The offset angle $A_2$ will vary between 0° and 360° as the carrier head motor 156 makes one revolution about the axis 127. One will note that a 0° angle of the offset angle $A_2$ is defined as a point where the axis 129 is coincident with a line NL (FIG. 3C), which is normal to the tangent line of the arc of the track 128 at the carriage 108's current position. The extent of the carrier head sweep angle $A_1$, which typically varies in a system due to substrate size, the size of the track 128, and size of platen 120, is set so that the substrate 10 disposed in the carrier head 126 does not extend past the polishing surface outline 130*o* during a polishing process, and thus can vary, for example, between +/−5°. The carrier head axis 129 will only intermittently be collinear with the platen central axis 121 during the polishing process, depending on the location of the carrier head 126 along the circular track 128, the offset distance 131, and the CH sweep angle $A_1$. If the offset distance 131 is shorter than the shortest distance between the circular track 128 and the center of the polishing surface 130*x*, then the carrier head axis 129 will never be collinear with the platen central axis 121 during the polishing process.

Figure 3D:
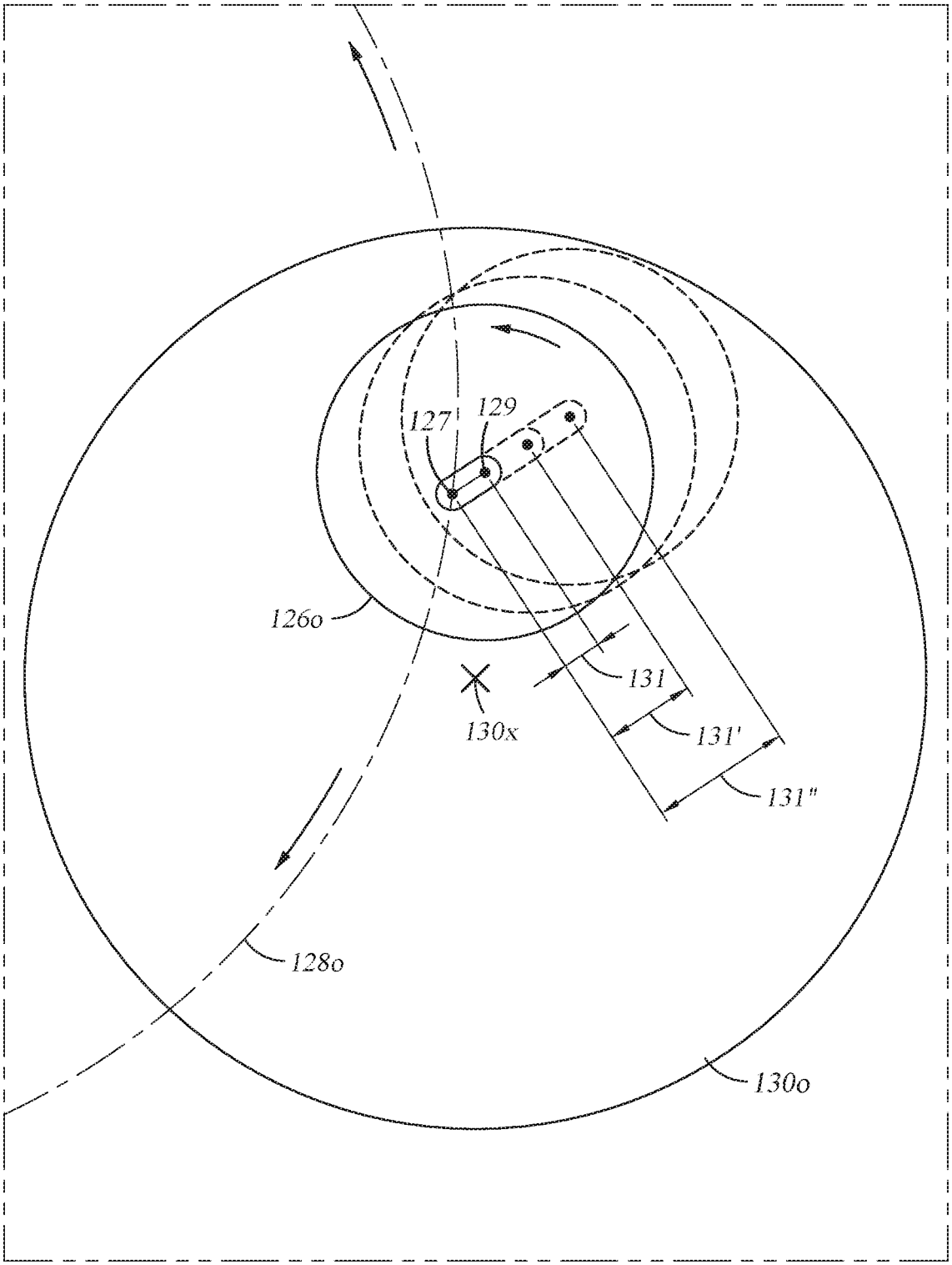
FIG. 3D is a diagram of the outline of the substrate at an instant of time during a polishing cycle in which a head-sweep offset is used, showing the outline of the substrate with different head-sweep offsets, according to one embodiment.

FIG. 3D illustrates a diagram of the carrier head, when the carriage 108 is stationary on the track outline 128*o*, showing the outline of the substrate with different head-sweep offsets 131, 131', 131". The axis 127 is fixed on the circular track

128*o*, but the different length of the offsets 131, 131', 131" results in a shifted carrier head axis 129. The position of the carrier head 126*o* on the surface of the polishing surface 130 also varies with the length of the offset 131, 131', 131".

The carrier head sweep angle $A_1$ may be restricted, such that no portion of the substrate 10 is displaced over the edge of the polishing surface 130, since this processing position can cause process variability and a reduced radial polishing uniformity. The maximum carrier head sweep angle is $2\theta_L$, wherein $\theta_L$ may be calculated by $$\theta_L = \cos^{-1}\left(\frac{d_{center}^2 + (r_{o-sw})^2 - (r_{platen} - r_{ring} - d)^2}{2d_{center}(r_{o-sw})}\right)$$

where $d_{center}$ is the distance from the center 101 of the circular track 128 to the center 130*x* of the polishing surface 130, $r_{o-sw}$ is the distance from the center 101 of the circular track to the axis 127, d is equal to the offset distance 131, $r_{platen}$ is the radius of the polishing surface 130, and $r_{ring}$ is the radius of the retaining ring 142.

FIG. 4A illustrates a plot 400 of the tangential normalized friction force T versus the offset angle $A_2$ in degrees, where the carrier head (CH) sweep angle $A_1$ is zero degrees, and thus axis 127 is on a line formed between the center of the polishing surface 130*x* and the center 101 of the circular track 128. The normalized friction force F is given by F=μN, where μ is a kinetic friction coefficient that varies between 0 and 1, and N is the normal force caused by the independently controllable pressurizable chambers 146 in the carrier head 126 that urge the substrate 10 against a polishing surface 130 disposed on the polishing surface 130. The tangential friction force T is given by $T=|F\cos(A_2)|$, and thus is a measure of the friction induced load that has to be compensated for by the carrier motor 157 (FIGS. 2A-2B) to keep the carrier head 126 in the same position on the track 128 at any instant in time at the offset angle $A_2$. When the offset angle $A_2$ is 0 or 180°, the tangential normalized friction force T is the same as with no offset distance 131, and the entirety of the normalized friction force is in the direction parallel to a tangent of the arc of the track 128 at that position. However, at any other angle $A_2$, the tangential normalized friction force T is reduced.

In FIG. 4A, the tangential normalized friction force T curve 410 for a 25 mm offset is plotted, the normalized friction force curve 420 for a 30 mm offset is plotted, the normalized friction force curve 430 for a 35 mm offset is plotted, and the normalized friction force curve 440 for a 40 mm offset is plotted. The average normalized friction force for a 25 mm offset is on average 96% of the zero offset case, the average normalized friction force for a 30 mm offset is on average 93% of the zero offset case, the average normalized friction force for a 35 mm offset is on average 89% of the zero offset case, and the average normalized friction force for a 40 mm offset is on average 81% of the zero offset case. As discussed above, the frictional force on the carrier head 126 requires a corresponding opposite but equal force on the carrier motor 157 to prevent it from sliding along the track 128, which puts extra wear and tear on the carrier motor. Reducing the force needed from the carrier motor 157 allows for less wear and tear on the carrier motor during operation. Alternatively, a less powerful carrier motor 157 can be used, as the carrier motor needs to produce less force to overcome the frictional force.

Figure 4B:
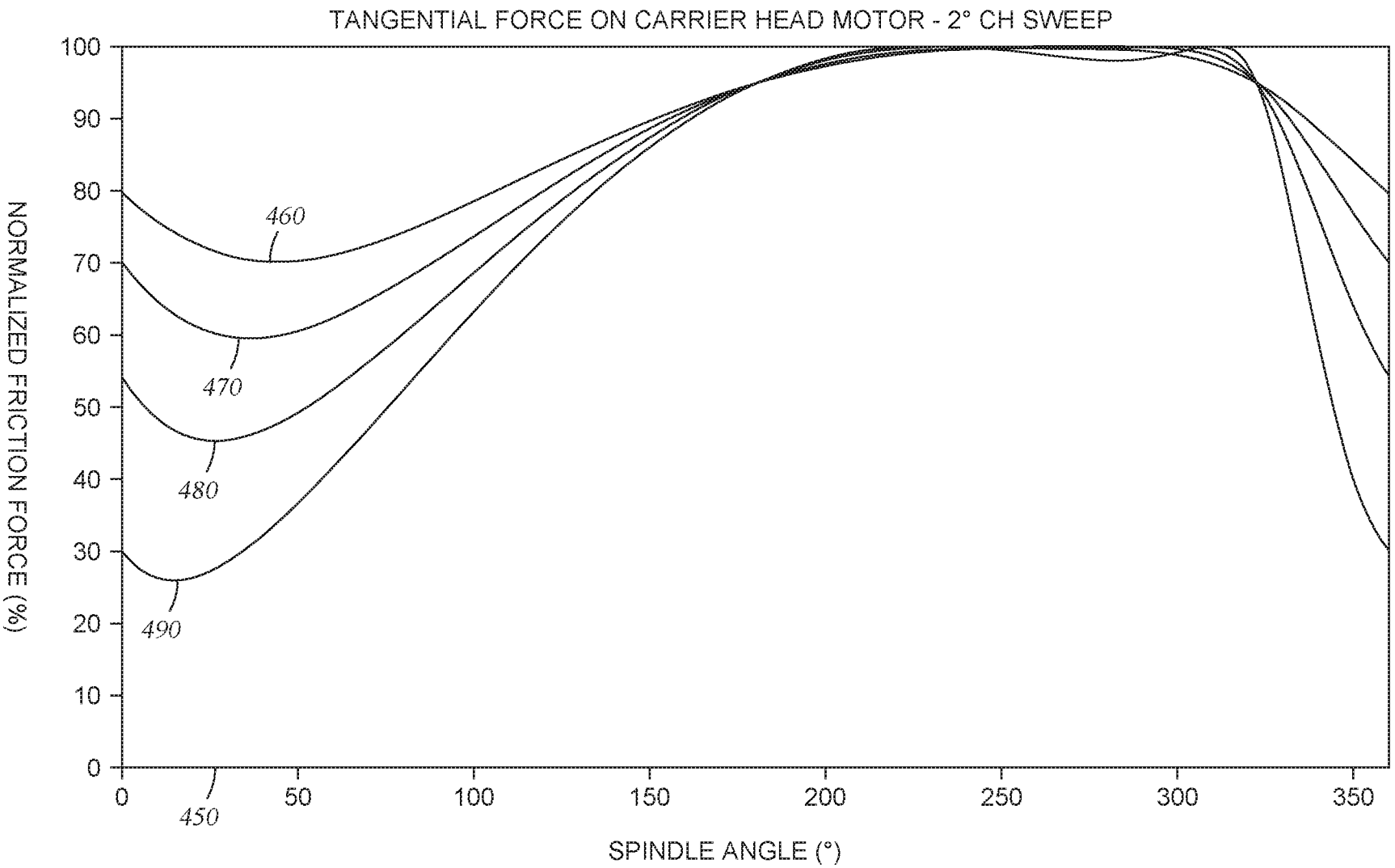
FIG. 4B is a plot of the normalized friction force respect to the spindle angle at a two degree sweep angle.

FIG. 4B illustrates a plot 450 of the tangential normalized friction force T versus the offset angle A2 in degrees, where the carrier head (CH) sweep angle A1 is two degrees. As shown in FIG. 4B, the normalized friction force curve 460 for the tangential normalized friction force T at a 25 mm offset is plotted, the normalized friction force curve 470 for a 30 mm offset is plotted, the normalized friction force curve 480 for a 35 mm offset is plotted, and the normalized friction force curve 490 for a 40 mm offset is plotted. The average normalized friction force for a 25 mm offset is on average 88% of the zero offset case, the average normalized friction force for a 30 mm offset is on average 84% of the zero offset case, the average normalized friction force for a 35 mm offset is on average 80% of the zero offset case, and the average normalized friction force for a 40 mm offset is on average 74% of the zero offset case. In all the above cases, at worst the tangential normalized friction force T is the same as the tangential normalized friction force without the offset distance 131, and in almost all cases, the tangential normalized friction force is reduced compared to the case without the offset distance 131. Thus, the increase in the offset distance 131 decreases the average tangential normalized friction force, which causes less wear and tear on the carrier head motor 156 and reduces the average system power usage. Additionally, a less powerful carrier head motor 156 can also be used to obtain the same normalized force, which allows use of a smaller motor that allows more room for other elements within the polishing system 100 and also reduces the piece part cost and cost to run the system.

The offset distance 131 also allows a shifted carrier head 126 to cover more surface area of the polishing surface 130. The offset distance 131 effectively provides an additional rotation of the carrier head 126 about the axis 140, which allows for a greater area traversed on the polishing surface 130.

The shifted carrier head 126 improves polishing uniformity, increases used proportion of the polishing surface 130, decreases the normalized friction force seen by the carrier motor 157, and causes less wear and tear on the carrier motor 157. The shifted carrier head 126 also allows for a less powerful, and thus smaller and less expensive, carrier motor 157 to achieve the same friction force as a traditional motor with no offset. As the polishing system 100 size is often fixed due to other constraints in the CMP process, the shifted carrier head 126 allows for improvements to the polishing uniformity and reduced normalized friction force, without a complete redesign of the system.

While the foregoing is directed to embodiments of the present disclosure, other and further embodiments of the disclosure may be devised without departing from the basic scope thereof, and the scope thereof is determined by the claims that follow.

What is claimed is:

1. A polishing system, comprising:

a first polishing station including a platen that has a polishing surface and a platen central axis about which the platen is configured to rotate;

an overhead track; and a carrier head assembly comprising:

a carriage that is configured to oscillate along the overhead track during polishing by a carrier motor;

a carrier head that is configured to retain a substrate;

an offset coupler; and a carrier head motor having a drive shaft, wherein the carrier head motor is coupled to the carriage, the drive shaft and the carrier head are coupled together by the offset coupler, a rotational axis of the drive shaft is a first offset distance from a connection axis of the carrier head assembly to the overhead track, and the rotational axis of the drive shaft is a second offset distance from and parallel to a carrier head axis of the carrier head.

2. The polishing system of claim 1, wherein the polishing system further comprises of a plurality of polishing stations.

3. The polishing system of claim 1, wherein the overhead track comprises a carousel with a plurality of arms.

4. The polishing system of claim 1, wherein the first offset distance is equal to the second offset distance.

5. The polishing system of claim 1, further comprising a controller configured to position the substrate disposed within the carrier head over a portion of the polishing surface of the platen, wherein the controller is configured to cause the carrier head to rotate about the rotational axis of the drive shaft of the carrier head motor during a polishing process, and the carrier head axis is not, or is only intermittently, collinear with the platen central axis during the polishing process.

6. The polishing system of claim 5, further comprising a secondary motor, wherein the secondary motor rotates the carrier head about a carrier head axis and wherein the controller is configured to operate the secondary motor.

7. The polishing system of claim 5, wherein the overhead track comprises a curved track and the carrier head assembly is moveable along the curved track.

8. The polishing system of claim 7, wherein the second offset distance is between 0.1% and 10% of a diameter of the curved track.

9. A carrier head assembly, comprising:

a carrier head that is configured to retain a substrate and urge the substrate against a polishing surface of a platen;

an offset coupler;

a carrier head motor having a drive shaft, wherein:

the carrier head motor is coupled to a carriage;

the drive shaft and the carrier head are coupled together by the offset coupler;

a rotational axis of the drive shaft is a first offset distance from a connection axis of the carrier head assembly to an overhead track;

the carriage is configured to oscillate along the overhead track during polishing by a carrier motor; and the rotational axis of the drive shaft is a second offset distance from and parallel to a carrier head axis of the carrier head.

10. The carrier head assembly of claim 9, wherein the supporting overhead track comprises a curved track and the carrier head assembly is moveable along the curved track.

11. The carrier head assembly of claim 10, wherein the second offset distance is between 0.1% and 10% of a diameter of the curved track.

12. The carrier head assembly of claim 11, further comprising a controller configured to position the substrate disposed within the carrier head over a portion of the polishing surface of the platen, wherein the controller is configured to cause the carrier head to rotate about the rotational axis of the drive shaft of the carrier head motor.

13. The carrier head assembly of claim 12, further comprising a secondary motor, wherein:

the secondary motor rotates the carrier head about the carrier head axis; and the controller is configured to cause the secondary motor to rotate the carrier head.

14. The carrier head assembly of claim 12, wherein the controller is configured to cause the carrier head to rotate while the carrier head assembly remains stationary on the curved track.

15. A method of polishing a substrate, comprising:

urging the substrate against a polishing surface of a platen by a carrier head assembly, wherein the carrier head assembly comprises:

a carrier head that is configured to retain the substrate;

an offset coupler; and a carrier head motor having a drive shaft, wherein:

the carrier head motor is coupled to a carriage;

the drive shaft and the carrier head are coupled together by the offset coupler;

a rotational axis of the drive shaft is a first offset distance from a connection axis of the carrier head assembly to an overhead track; and the rotational axis of the drive shaft is a second offset distance from and parallel to a carrier head axis of the carrier head;

rotating the carrier head about the rotational axis of the drive shaft, wherein the carrier head motor causes the carrier head to rotate about the rotational axis;

rotating the platen about a platen central axis; and oscillating the carriage along the overhead track.

16. The method of claim 15, wherein the overhead track further comprises a curved track, and the method further comprises:

moving the carrier head assembly along the curved track, by use of a carrier motor that is coupled to the carrier head motor, while urging the substrate against a polishing surface and rotating the carrier head about the rotational axis of the drive shaft.

17. The method of claim 15, wherein the overhead track further comprises a curved track, and the method further comprises:

translating the carrier head assembly an angular displacement, wherein the angular displacement is greater than zero and less than a first angle measured relative to a center of the curved track, wherein the first angle is defined by $$2\theta_L = 2\cos^{-1}\left(\frac{d_{center}^2 + (r_{o-sw})^2 - (r_{platen} - r_{ring} - d)^2}{2d_{center}(r_{o-sw})}\right)$$

where $d_{center}$ is a distance from the center of the curved track to the platen central axis of the platen, $r_{o-sw}$ is a distance from the center of the curved track to the rotational axis of the drive shaft, d is equal to the second offset distance, $r_{platen}$ is a radius of the platen, and $r_{ring}$ is a radius of a retaining ring that is coupled to and is concentric with the carrier head axis of the carrier head.

18. The method of claim 15, wherein the overhead track comprises a curved track and the second offset distance is between 0.1% and 10% of a diameter of the curved track.

19. The method of claim 15, wherein the carrier head assembly further comprises a controller configured to position the substrate disposed within the carrier head over a portion of the polishing surface of the platen, wherein the controller is configured to cause the carrier head to rotate about the rotational axis of the drive shaft of the carrier head motor during a polishing process, and the carrier head axis is not, or is only intermittently, collinear with the platen central axis during the polishing process.

20. The method of claim 19, wherein the carrier head assembly further comprises a secondary motor, wherein the method further comprises:

rotating the carrier head about the carrier head axis of the carrier head by use of a secondary motor that is disposed between the offset coupler and the carrier head.

21. The method of claim 19, wherein the overhead track further comprises a curved track, and the controller is configured to cause the carrier head to rotate while the carrier head assembly oscillates on the curved track.

* * * * *